US012104374B2

(12) United States Patent
Okumura et al.

(10) Patent No.: US 12,104,374 B2
(45) Date of Patent: Oct. 1, 2024

(54) SOUND INSULATION STRUCTURE OF PARTITION WALL AND METHOD FOR CONSTRUCTING PARTITION WALL

(71) Applicant: SEKISUI HOUSE, LTD., Osaka (JP)

(72) Inventors: Miki Okumura, Osaka (JP); Hideo Nagamatsu, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 168 days.

(21) Appl. No.: 17/792,830

(22) PCT Filed: Jan. 26, 2021

(86) PCT No.: PCT/JP2021/002549
§ 371 (c)(1),
(2) Date: Jul. 14, 2022

(87) PCT Pub. No.: WO2021/153535
PCT Pub. Date: Aug. 5, 2021

(65) Prior Publication Data

US 2023/0044172 A1 Feb. 9, 2023

(30) Foreign Application Priority Data

Jan. 29, 2020 (JP) ..... 2020-012618

(51) Int. Cl.
*E04B 2/74* (2006.01)
*E04B 1/82* (2006.01)
(Continued)

(52) U.S. Cl.
CPC ..... *E04B 2/7457* (2013.01); *E04B 1/82* (2013.01); *E04B 1/8409* (2013.01); *E04B 2/58* (2013.01);
(Continued)

(58) Field of Classification Search
CPC ..... E04B 1/82; E04B 1/86; E04B 1/8409; E04B 2/58; E04B 2/7412; E04B 2/7457; E04B 2/74; E04B 2/82
See application file for complete search history.

(56) References Cited

U.S. PATENT DOCUMENTS 3,292,328 A 12/1966 Lewis et al.
4,622,791 A * 11/1986 Cook ..... E04B 2/825 52/288.1
(Continued)

FOREIGN PATENT DOCUMENTS

CA 3129692 A1 * 3/2022 ..... E04B 1/84
CA 3129697 A1 * 3/2022 ..... E04B 2/60
(Continued)

OTHER PUBLICATIONS

International Search Report (PCT/ISA/210) issued in PCT/JP2021/002549, dated Apr. 20, 2021.
(Continued)

*Primary Examiner* — Jessie T Fonseca
(74) *Attorney, Agent, or Firm* — Birch, Stewart, Kolasch & Birch, LLP

(57) ABSTRACT

A partition wall sound insulation structure includes: a floor material on which a floor surface facing an indoor space side is formed; a ceiling material on which a ceiling surface is formed, the ceiling surface being opposed to the floor surface in a vertical direction with an indoor space interposed therebetween; a partition wall that extends in the vertical direction so as to partition the indoor space in a horizontal direction and that is disposed with a gap from at least one surface of the floor surface and the ceiling surface; and a sound insulation material made from an elastic material and including a portion disposed in the gap while being compressed in the vertical direction.

7 Claims, 26 Drawing Sheets

(51) Int. Cl.
*E04B 1/84* (2006.01)
*E04B 2/58* (2006.01)
*E04B 2/82* (2006.01)

(52) U.S. Cl.
CPC ..... *E04B 2/74* (2013.01); *E04B 2/7412* (2013.01); *E04B 2/82* (2013.01)

(56) References Cited

U.S. PATENT DOCUMENTS

| | | | | | |
|---|---|---|---|---|---|
| 5,907,932 | A * | 6/1999 | LeConte | E04B 2/7411 | 52/144 |
| 2005/0210798 | A1* | 9/2005 | Burg | E04B 2/7457 | 52/481.1 |
| 2015/0361659 | A1* | 12/2015 | Sessler | E04B 2/7457 | 52/483.1 |

FOREIGN PATENT DOCUMENTS

| | | | | | |
|---|---|---|---|---|---|
| JP | 6-248720 | A | | 9/1994 | |
| JP | 2001254454 | A | * | 9/2001 | |
| JP | 2001-295451 | A | | 10/2001 | |
| JP | 2017-203310 | A | | 11/2017 | |
| WO | WO-2011129580 | A2 | * | 10/2011 | E04B 2/7409 |
| WO | WO-2018219491 | A1 | * | 12/2018 | E04B 2/7411 |
| WO | WO-2021153534 | A1 | * | 8/2021 | E04B 1/82 |
| WO | WO-2021153536 | A1 | * | 8/2021 | E04B 1/82 |

OTHER PUBLICATIONS

Japanese Notification of a Preissuance Submission by Third Party issued in corresponding Japanese Application No. 2020-012618, dated Feb. 14, 2023, with an English summary.

* cited by examiner

SOUND INSULATION STRUCTURE OF PARTITION WALL AND METHOD FOR CONSTRUCTING PARTITION WALL

TECHNICAL FIELD

The present invention relates to a partition wall sound insulation structure and a partition wall construction method.

BACKGROUND ART

In general, a partition wall is constructed by a floor/ceiling preceding method, and in the construction, a gap may be generated between a lower end portion of the partition wall and a floor surface, and a gap may be generated between an upper end portion of the partition wall and a ceiling surface. Since these gaps cause sound leakage between adjacent chambers, various studies have been made on measures for improving sound insulation performance of partition walls.

Patent Literature 1 describes, as this type of technique, loading a sound insulation material on a lower end portion side of a partition wall. The sound insulation material is made from glass wool, a plastic foam, plastic hollow fibers such as polyester hollow fibers, or the like. Patent Literature 1 describes that such a sound insulation material obtains an effect of preventing propagation of floor impact sound to a neighboring chamber via the partition wall.

As described above, although Patent Literature 1 proposes a countermeasure for sound insulation between chambers partitioned by partition walls, the countermeasure is directed to floor impact sound, and no countermeasure is taken against propagation of sound of the partition walls themselves.

CITATION LIST

Patent Literature

Patent Literature 1: JP 2001-295451 A

SUMMARY OF INVENTION

An object of the present invention is to provide a partition wall sound insulation structure enabling further improvement of sound insulation performance, and a partition wall construction method.

A partition wall sound insulation structure according to one aspect of the present invention includes: a floor material on which a floor surface facing an indoor space side is formed; a ceiling material on which a ceiling surface is formed, the ceiling surface being opposed to the floor surface in a vertical direction with an indoor space interposed therebetween; a partition wall that extends in the vertical direction so as to partition the indoor space in a horizontal direction and that is disposed with a gap from at least one surface of the floor surface and the ceiling surface; and a sound insulation material made from an elastic material and including a portion disposed in the gap while being compressed in the vertical direction.

A partition wall construction method according to another aspect of the present invention is a method of constructing a partition wall that partitions an indoor space in a horizontal direction in a building including a floor material on which a floor surface facing an indoor space side is formed; and a ceiling material on which a ceiling surface is formed, the ceiling surface being opposed to the floor surface in a vertical direction with the indoor space interposed therebetween. This method includes: disposing a sound insulation material made from an elastic material at a construction position where the partition wall is to be constructed on at least one surface of the floor surface and the ceiling surface; and constructing the partition wall at the construction position such that the sound insulation material is sandwiched between the partition wall and the at least one surface and compressed in the vertical direction.

According to the present invention, it is possible to provide a partition wall sound insulation structure enabling further improvement of sound insulation performance, and a partition wall construction method.

DESCRIPTION OF EMBODIMENTS

In the following, a partition wall sound insulation structure and a partition wall construction method according to embodiments of the present invention will be described in detail with reference to the drawings.

First Embodiment

Figure 1:
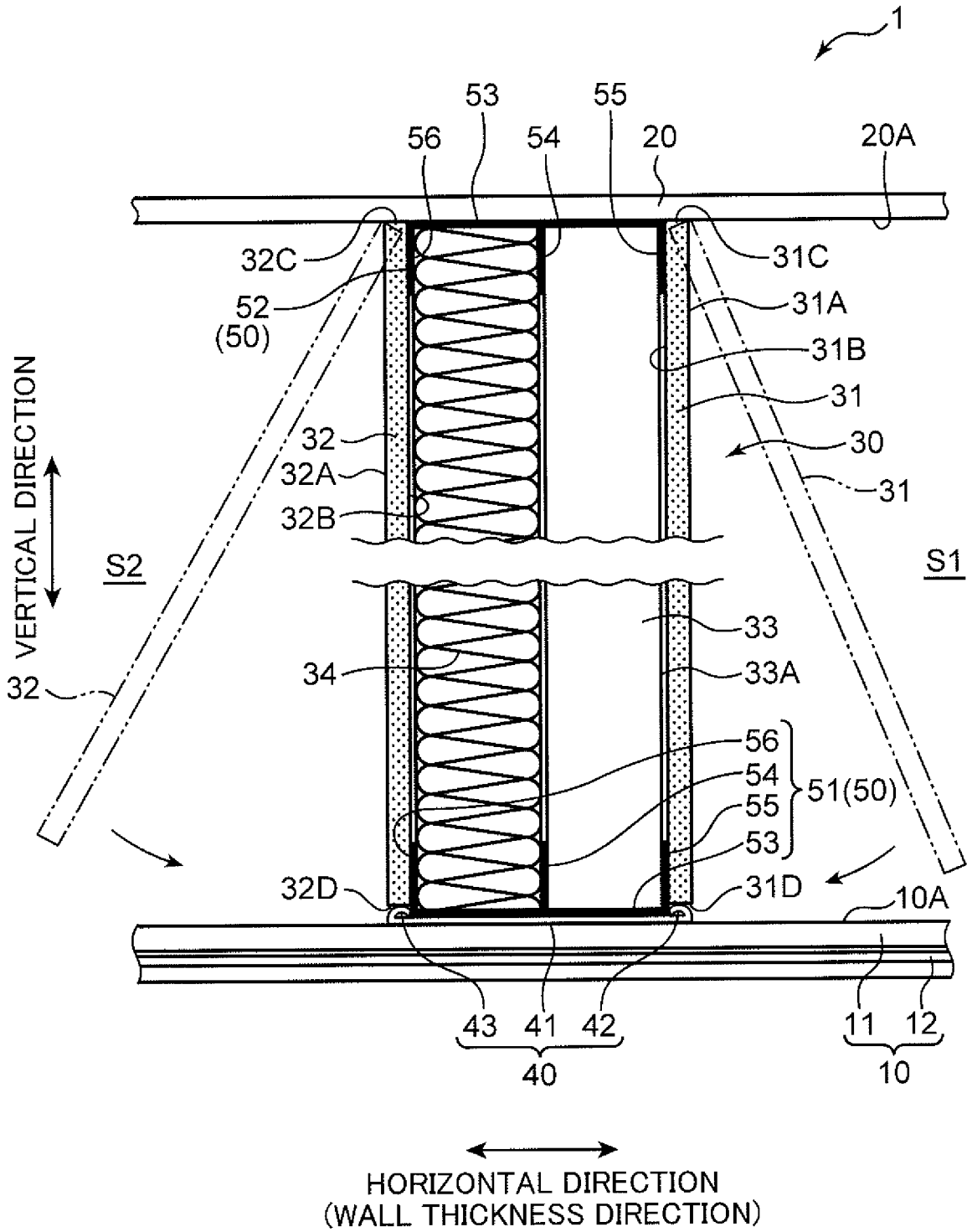
FIG. 1 is a vertical sectional view schematically illustrating a configuration of a partition wall sound insulation structure according to a first embodiment of the present invention.

First, a partition wall sound insulation structure 1 (hereinafter, also simply referred to as the "sound insulation structure 1") according to a first embodiment of the present invention will be described with reference to FIGS. 1 to 5. The sound insulation structure 1 is for suppressing sound leakage from one of indoor spaces (a first indoor space S1 and a second indoor space S2) partitioned by a partition wall 30 to the other space in, for example, a building such as a house. FIG. 1 shows a cross section of the partition wall 30 taken along a vertical direction. As illustrated in FIG. 1, the sound insulation structure 1 mainly includes a floor material 10, a ceiling material 20, the partition wall 30, a sound insulation material 40, and a positioning member 50. Each of these components will be described below.

A horizontal floor surface 10A facing the indoor space side is formed on the floor material 10. As illustrated in FIG. 1, the floor material 10 includes a plywood 12 disposed horizontally, and a flooring 11 disposed on the plywood 12. An upper surface of the flooring 11 is the floor surface 10A.

A ceiling surface 20A is formed on the ceiling material 20, the ceiling surface being opposed to the floor surface 10A in the vertical direction with the indoor space interposed therebetween. The ceiling surface 20A is a surface parallel to the floor surface 10A. Although the ceiling material 20 is made of, for example, a gypsum plasterboard or the like, the material is not limited thereto.

The partition wall 30 extends in the vertical direction so as to partition the indoor space in a horizontal direction, and has a predetermined width in a wall surface direction (a direction orthogonal to a paper surface in FIG. 1). As illustrated in FIG. 1, the partition wall 30 according to the present embodiment is disposed such that an upper end portion thereof is in contact with the ceiling surface 20A and a gap is formed in the vertical direction between a lower end portion thereof and the floor surface 10A. The partition wall 30 has a first face material 31, a second face material 32 disposed with a hollow portion interposed between the first face material 31 and the second face material in the horizontal direction, and a stud 33 (stud) and a sound absorbing material 34 disposed in the hollow portion.

The first face material 31 is made of, for example, a gypsum plasterboard having a rectangular shape in a front view, and extends in the vertical direction. The first face material 31 includes a first outer surface 31A facing the first indoor space S1 side, a first inner surface 31B facing a side (the hollow portion side of the partition wall 30) opposite to the first outer surface 31A, an upper end surface 31C, and a lower end surface 31D. A width (a height dimension) of the first face material 31 in the vertical direction is smaller than a distance between the floor surface 10A and the ceiling surface 20A. As illustrated in FIG. 1, the first face material 31 in the present embodiment is disposed such that the upper end surface 31C abuts on the ceiling surface 20A and a gap is formed in the vertical direction between the lower end surface 31D and the floor surface 10A.

The second face material 32 is made of a gypsum plasterboard or the like having the same size and shape as those of the first face material 31, and extends in the vertical direction. The second face material 32 includes a second outer surface 32A facing the second indoor space S2, a second inner surface 32B facing a side (the hollow portion side of the partition wall 30) opposite to the second outer surface 32A, an upper end surface 32C, and a lower end surface 32D. Similarly to the first face material 31, the second face material 32 is disposed such that the upper end surface 32C abuts on the ceiling surface 20A and a gap is formed in the vertical direction between the lower end surface 32D and the floor surface 10A.

The stud 33 is a member for supporting the first face material 31 or the second face material 32. As illustrated in FIG. 1, the stud 33 extends in the vertical direction from the floor surface 10A to the ceiling surface 20A, and has a side surface 33A to which the first face material 31 is fixed by a fixing tool (not illustrated) such as a screw. Note that although not illustrated, a stud for supporting the second face material 32 is also disposed in the hollow portion of the partition wall 30.

The sound absorbing material 34 is a member for absorbing sound propagated from the first indoor space S1 or the second indoor space S2 to the partition wall 30. The sound absorbing material 34 is disposed so as to fill a space in the hollow portion of the partition wall 30 where the stud 33 is not disposed.

Figure 2:
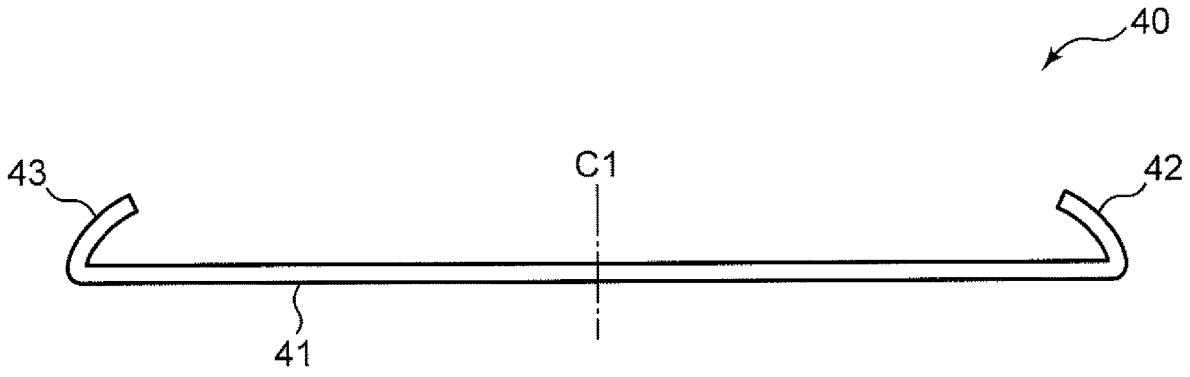
FIG. 2 is a view schematically illustrating a configuration of a sound insulation material in the first embodiment of the present invention.

The sound insulation material 40 is made from an elastic material, and includes a portion disposed in a gap between the lower end surface 31D, 32D of the partition wall 30 and the floor surface 10A in a state of being compressed in the vertical direction. Although the sound insulation material 40 is made from, for example, a mixed material of a viscoelastic material such as rubber and a resin, the material is not limited thereto. As illustrated in FIGS. 1 and 2, the sound insulation material 40 includes a sheet portion 41 disposed on the floor surface 10A in a range from the first face material 31 to the second face material 32, a first protruding portion 42 protruding in a sheet thickness direction from one end portion of the sheet portion 41 in a width direction (the wall thickness direction of the partition wall 30), and a second protruding portion 43 protruding in the sheet thickness direction from the other end portion of the sheet portion 41 in the width direction.

The sheet portion 41 is a flat elastic sheet having a predetermined width in the wall thickness direction of the partition wall 30 and a predetermined length in the wall surface direction (the direction perpendicular to the wall thickness direction), and has a thickness smaller than the gap between the lower end surface 31D, 32D of the partition wall 30 and the floor surface 10A. The first protruding portion 42 is disposed in the gap between the lower end surface 31D of the first face material 31 and the floor surface 10A in a state of being compressed in the vertical direction. The second protruding portion 43 is disposed in the gap between the lower end surface 32D of the second face material 32 and the floor surface 10A while being compressed in the vertical direction.

More specifically, both the ends in the width direction of the sound insulation material 40 are formed in a shape that becomes thicker toward the center (a reference sign C1 in FIG. 2) in the width direction of the sound insulation material 40. In other words, as illustrated in FIG. 2, the first protruding portion 42 extends while being curved in an arc shape protruding upward from one end portion in the width direction of the sheet portion 41 toward the center in the width direction, and is provided such that a spaced distance from the sheet portion 41 increases as approaching the center in the width direction. The second protruding portion 43 extends while being curved in an arc shape protruding upward from the other end portion in the width direction of the sheet portion 41 toward the center in the width direction, and is provided such that the spaced distance from the sheet portion 41 increases as approaching the center in the width direction. The sound insulation material 40 is formed in a symmetrical shape with respect to the center in the width direction.

Figure 3:
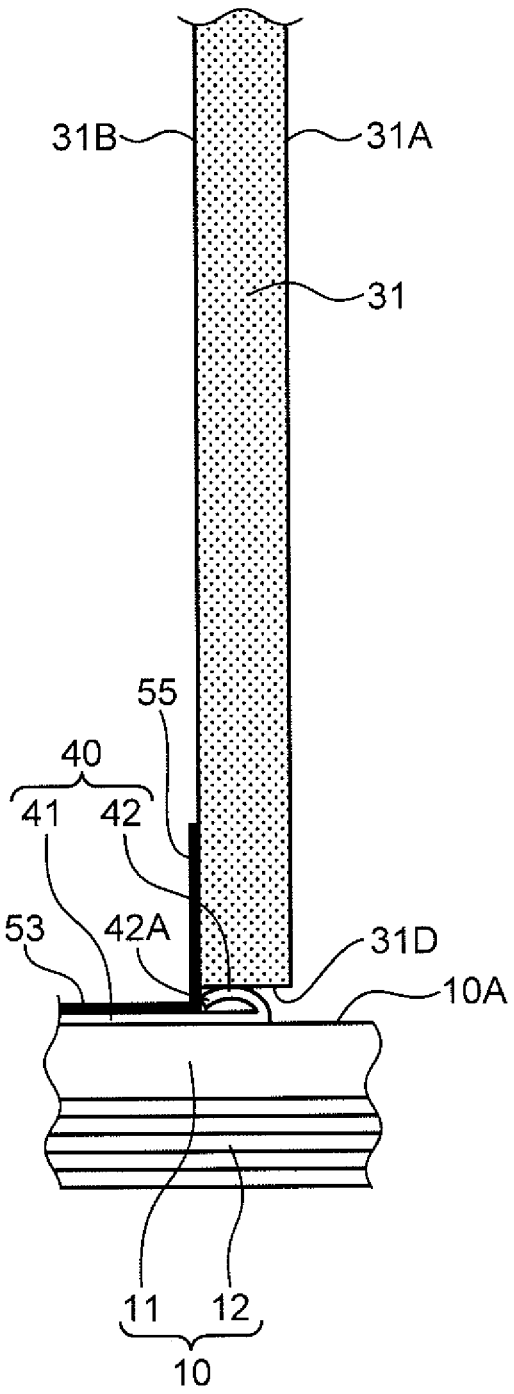
FIG. 3 is a schematic view showing a state in which an end portion of the sound insulation material is sandwiched between a lower end surface of a partition wall and a floor surface in the first embodiment of the present invention.
Figure 4:
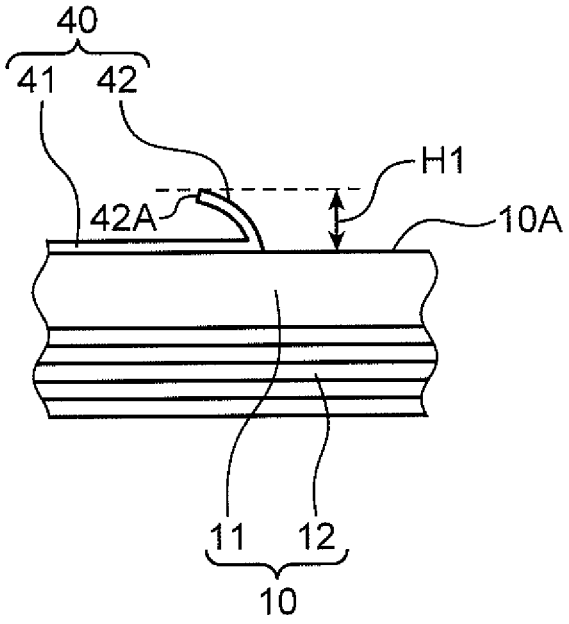
FIG. 4 is a schematic view illustrating a state before the end portion of the sound insulation material is sandwiched between the lower end surface of the partition wall and the floor surface in the first embodiment of the present invention.

FIG. 3 illustrates a state in which the first protruding portion 42 is sandwiched and compressed between the lower end surface 31D of the first face material 31 and the floor surface 10A. On the other hand, FIG. 4 illustrates a state before the first protruding portion 42 is sandwiched between the lower end surface 31D of the first face material 31 and the floor surface 10A. Before the first protruding portion 42 is sandwiched between the lower end surface 31D of the first face material 31 and the floor surface 10A, an extending end 42A is spaced apart from the sheet portion 41 (FIG. 4), and in a state where the first protruding portion is sandwiched between the lower end surface 31D of the first face material 31 and the floor surface 10A, the extending end 42A is in contact with an upper surface of the sheet portion 41 (FIG. 3).

A maximum height H1 (FIG. 4) of the first protruding portion 42 before being sandwiched between the lower end surface 31D of the first face material 31 and the floor surface 10A is larger than the gap between the lower end surface 31D of the first face material 31 and the floor surface 10A. The maximum height H1 is a height from a base end portion (a portion connected to the sheet portion 41) of the first protruding portion 42 to the extending end 42A. While the states before and after compression of the first protruding portion 42 have been described with reference to FIGS. 3 and 4, the same applies also to the second protruding portion 43.

The sound insulation material 40 has a width that falls within a thickness range of the partition wall 30. Specifically, as illustrated in FIG. 1, the one end portion (a right end portion in FIG. 1) in the width direction of the sound insulation material 40 (the sheet portion 41) is located on the inner side in the width direction (the center side in the wall thickness direction of the partition wall 30) than the first outer surface 31A, and does not extend to the outer side in the width direction than the first outer surface 31A. Similarly, the other end portion (a left end portion in FIG. 1) in the width direction of the sound insulation material 40 (the sheet portion 41) is located on the inner side in the width direction than the second outer surface 32A, and does not extend to the outer side in the width direction than the second outer surface 32A. A width of the first protruding portion 42 in the horizontal direction (the wall thickness direction) is smaller than a thickness of the first face material 31, and a width of the second protruding portion 43 in the horizontal direction (the wall thickness direction) is smaller than a thickness of the second face material 32. The one end portion of the sound insulation material 40 in the width direction may be flush with the first outer surface 31A, and the other end portion of the sound insulation material 40 in the width direction may be flush with the second outer surface 32A.

The positioning member 50 (runner) is a member that positions the stud 33 in the horizontal direction (the wall thickness direction of the partition wall 30), and includes a floor-side positioning member 51 disposed on the floor surface 10A side and a ceiling-side positioning member 52 disposed on the ceiling surface 20A side. The floor-side positioning member 51 and the ceiling-side positioning member 52 are formed in the same shape and size, and have a predetermined length in the wall surface direction of the partition wall 30 (the direction orthogonal to a paper surface in FIG. 1). The floor-side positioning member 51 and the ceiling-side positioning member 52 are disposed so as to be opposed to each other in the vertical direction. Although the positioning member 50 is, for example, a member made of a thin iron plate, the material is not limited thereto.

Figure 5:
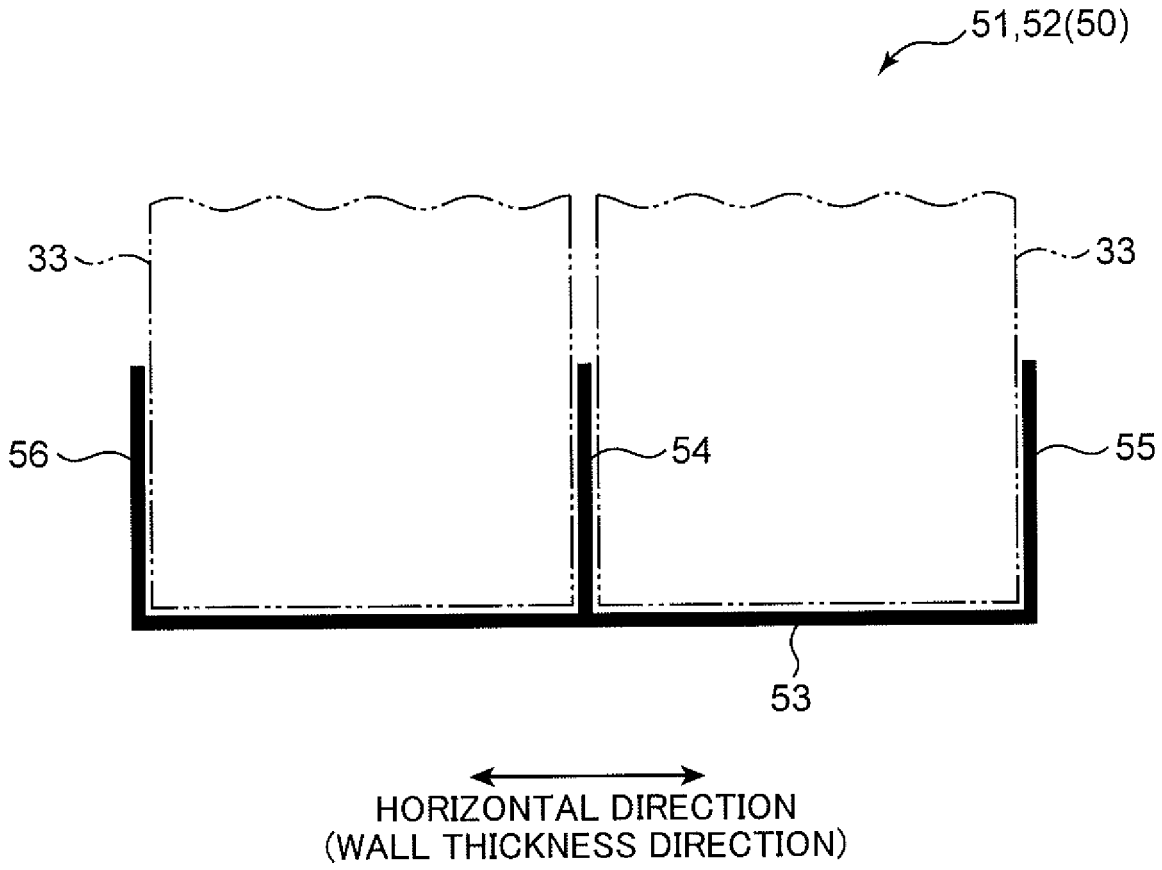
FIG. 5 is a view schematically illustrating a configuration of a positioning member in the first embodiment of the present invention.

FIG. 5 illustrates a configuration of the positioning member 50 (the floor-side positioning member 51 and the ceiling-side positioning member 52). The positioning member 50 includes a flat base portion 53, a central erect portion 54 vertically rising from the base portion 53, a first end side erect portion 55, and a second end side erect portion 56. The central erect portion 54 is erected perpendicularly to the base portion 53 from a central portion in a width direction of the base portion 53. The first end side erect portion 55 and the second end side erect portion 56 are erected perpendicularly to the base portion 53 from both end portions in the width direction of the base portion 53. The base portion 53 is an iron plate having a predetermined width in the wall thickness direction of the partition wall 30 and a predetermined length in the wall surface direction. The central erect portion 54, the first end side erect portion 55, and the second end side erect portion 56 have a predetermined length in the wall surface direction, and are provided parallel to each other along the wall surface direction.

A width between the central erect portion 54 and the first end side erect portion 55 is equal to or larger than a width of the stud 33. Similarly, a width between the central erect portion 54 and the second end side erect portion 56 is equal to or larger than the width of the stud 33. Therefore, as indicated by a two-dot chain line in FIG. 5, a lower end portion of the stud 33 can be inserted into the gap between the central erect portion 54 and the first end side erect portion 55 or the gap between the central erect portion 54 and the second end side erect portion 56. In this state, movement of the stud 33 in the horizontal direction (the wall thickness direction of the partition wall 30) is regulated by the central erect portion 54, the first end side erect portion 55, and the second end side erect portion 56. In the following description, a space between the central erect portion 54 and the first end side erect portion 55 and a space between the central erect portion 54 and the second end side erect portion 56 are also referred to as groove portions of the positioning member 50.

The floor-side positioning member 51 in the present embodiment is configured as a separate body from the sheet portion 41. As illustrated in FIG. 1, the floor-side positioning member 51 is placed on the upper surface of the sheet portion 41, and is sandwiched in the width direction by the first protruding portion 42 and the second protruding portion 43. The first end side erect portion 55 is located between the first inner surface 31B and the side surface 33A of the stud 33, the second end side erect portion 56 is located between the second inner surface 32B and a side surface of the stud (the side surface of the stud by which the second face material 32 is supported), and the central erect portion 54 is located between the stud 33 and the sound absorbing material 34.

Next, a partition wall construction method according to the present embodiment will be described with reference to a flowchart of FIG. 6. In this construction method, the partition wall 30 partitioning the indoor space in the horizontal direction is constructed in a building including the floor material 10 and the ceiling material 20 by the following procedure.

First, a construction position of the partition wall 30 is determined (Step S10). In this step, marking is performed at a position where the construction of the partition wall 30 is planned on the floor surface 10A.

Next, on the floor surface 10A, the sound insulation material 40 is disposed at the construction position where the partition wall 30 is to be constructed (Step S20). Specifically, the sound insulation material 40 is laid on the floor surface 10A at the position marked in Step S10. At this time, the sound insulation material 40 is laid on the floor surface 10A such that the first protruding portion 42 and the second protruding portion 43 face the upper side (the ceiling surface 20A side).

In the following Steps S30 to S60, the partition wall 30 is constructed at the construction position so that the sound insulation material 40 is sandwiched between the partition wall 30 and the floor surface 10A and compressed in the vertical direction.

First, the positioning member 50 is disposed (Steps S30 and S40). In the present embodiment, first, the floor-side positioning member 51 is placed on the sound insulation material 40. At this time, the floor-side positioning member 51 is placed on the upper surface of the sheet portion 41, and is brought into a state of being sandwiched between the first protruding portion 42 and the second protruding portion 43 in the width direction. In other words, the floor-side positioning member 51 is not placed on the first protruding portion 42 and the second protruding portion 43.

Then, the floor-side positioning member 51 is fixed to the floor surface 10A together with the sound insulation material 40 using a fixing tool such as a screw. Thereafter, the ceiling-side positioning member 52 is disposed on the ceiling surface 20A at a position opposed to the floor-side positioning member 51 in the vertical direction, and is similarly fixed to the ceiling surface 20A using a fixing tool such as a screw. Note that the ceiling-side positioning member 52 may be first fixed to the ceiling surface 20A, and then the floor-side positioning member 51 may be fixed to the floor surface 10A.

Next, the stud 33 and the sound absorbing material 34 are disposed (Step S50). In this step, the lower end portion of the stud 33 is inserted into the groove portion of the floor-side positioning member 51, and an upper end portion of the stud 33 is inserted into the groove portion of the ceiling-side positioning member 52. A plurality of the studs 33 are disposed at intervals in the wall surface direction of the partition wall 30. Further, the studs 33 are disposed in the space between the central erect portion 54 and the first end side erect portion 55 as a supporting member for the first face material 31, and are disposed in the space between the central erect portion 54 and the second end side erect portion 56 as a supporting member for the second face material 32. Thereafter, the sound absorbing material 34 is disposed so as to fill the gap between the studs 33.

Next, the first face material 31 and the second face material 32 are constructed (Step S60). In this step, as indicated by a two-dot chain line in FIG. 1, first, the first face material 31 is lifted by a board lifting machine, and an upper end portion thereof is abutted on a portion (a right side portion in FIG. 1) of the ceiling surface 20A adjacent to the ceiling-side positioning member 52.

Then, a lower end portion of the first face material 31 is rotated inward around the abutment portion toward the first protruding portion 42 of the sound insulation material 40. As a result, the first protruding portion 42 elastically deforms upon receiving an inward pressing force in the horizontal direction and a downward pressing force in the vertical direction from the lower end portion of the first face material 31. Then, after the first face material 31 is rotated until the first face material becomes perpendicular to the floor material 10 and the ceiling material 20, the first face material 31 is fixed to the stud 33 using a fixing tool such as a screw. As a result, the first protruding portion 42 is brought into a state of being compressed in the vertical direction in the gap between the lower end surface 31D of the first face material 31 and the floor surface 10A.

The second face material 32 is also constructed by the same procedure as that for the first face material 31. Specifically, an upper end portion of the second face material 32 is abutted on a portion (a left side portion in FIG. 1) of the ceiling surface 20A, the portion being adjacent to the ceiling-side positioning member 52, and a lower end portion of the second face material 32 is rotated inward around the abutment portion toward the second protruding portion 43 of the sound insulation material 40. As a result, the second protruding portion 43 is elastically deformed upon receiving an inward pressing force in the horizontal direction and a downward pressing force in the vertical direction from the lower end portion of the second face material 32, and is brought into a state of being compressed in the vertical direction in the gap between the lower end surface 32D of the second face material 32 and the floor surface 10A. The partition wall 30 is constructed by the foregoing procedure, and the indoor space is partitioned into the first indoor space S1 and the second indoor space S2.

As described in the foregoing, in the partition wall sound insulation structure 1 according to the present embodiment, the gaps between the floor surface 10A and the lower end surfaces 31D and 32D of the partition wall 30 are blocked by the first protruding portion 42 and the second protruding portion 43 of the sound insulation material 40, respectively, and the first protruding portion 42 and the second protruding portion 43 are deformed while being compressed in the vertical direction. As a result, a restoring force of the sound insulation material 40 is generated, so that adhesion of the sound insulation material 40 to the lower end surfaces 31D and 32D of the partition wall 30 is improved. Accordingly, sound leakage between chambers through the gaps between the lower end surfaces 31D and 32D of the partition wall 30 and the floor surface 10A can be effectively suppressed to further improve sound insulation performance.

In addition, the partition wall construction method according to the present embodiment is a dry construction method in which the first face material 31 and the second face material 32 are each constructed after the sheet-like sound insulation material 40 is arranged on the floor surface 10A in advance, and is different from a method in which a gap between the face material and the floor surface 10A is blocked by caulking after construction of the face material. In the case of caulking, there occur problems that curing is required in advance in order to prevent contamination of the surroundings, that a difference in sound insulation performance is likely to occur depending on a filling amount of caulking, and that caulking is thinned due to aging degradation, or the like. By contrast, in the present construction method, such problems will not occur, and desired sound insulation performance can be reliably obtained by simple construction.

Here, shapes of sound insulation materials in modifications of the present embodiment will be described with reference to FIGS. 7 to 11.

Figure 7:
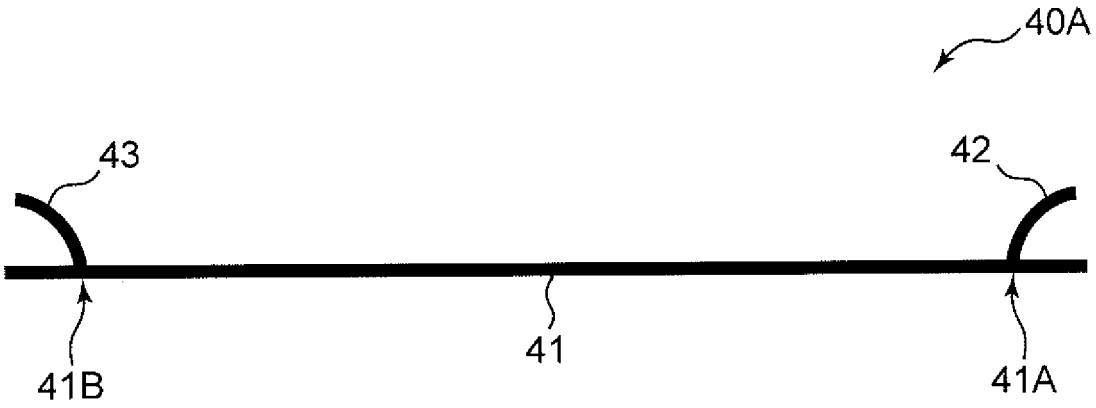
FIG. 7 is a view schematically illustrating a configuration of a sound insulation material in a modification of the first embodiment of the present invention.

In a sound insulation material 40A according to a modification shown in FIG. 7, the first protruding portion 42 extends while being curved from a portion 41A on the center side in the width direction of the sheet portion 41 with respect to one end portion (a right end portion in FIG. 7) in the width direction toward the one end portion in the width direction, and is provided such that a spaced distance from the sheet portion 41 increases as approaching the one end portion in the width direction. Similarly to the first protruding portion 42, the second protruding portion 43 extends while being curved from a portion 41B on the center side in the width direction of the sheet portion 41 with respect to the other end portion (a left end portion in FIG. 7) in the width direction toward the other end portion in the width direction, and is provided such that a spaced distance from the sheet portion 41 increases as approaching the other end portion in the width direction.

Figure 8:
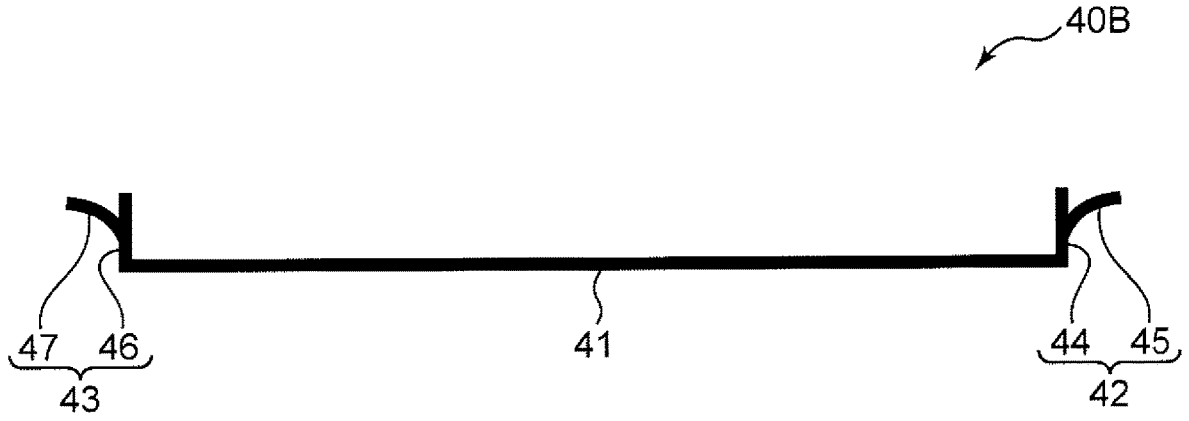
FIG. 8 is a view schematically illustrating a configuration of a sound insulation material in another modification of the first embodiment of the present invention.

In a sound insulation material 40B illustrated in a modification shown in FIG. 8, the first protruding portion 42 includes a first vertical portion 44 vertically rising from the one end portion in the width direction of the sheet portion 41, and a first curved portion 45 curved in an arc shape protruding upward from a side surface of the first vertical portion 44 toward the outer side in the width direction. Similarly to the first protruding portion 42, the second protruding portion 43 includes a second vertical portion 46 vertically rising from the other end portion in the width direction of the sheet portion 41, and a second curved portion 47 curved in an arc shape protruding upward from a side surface of the second vertical portion 46 toward the outer side in the width direction.

Figure 9:
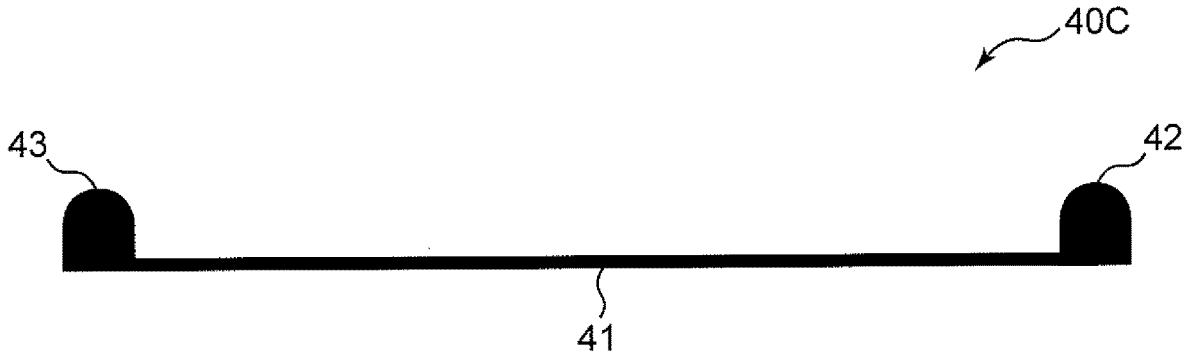
FIG. 9 is a view schematically illustrating a configuration of a sound insulation material in still another modification of the first embodiment of the present invention.

In a sound insulation material 40C illustrated in a modification shown in FIG. 9, the first protruding portion 42 and the second protruding portion 43 have a solid structure, and extend upward with a fixed width from the end portion in the width direction of the sheet portion 41 and have a curved extending end.

Figure 10:
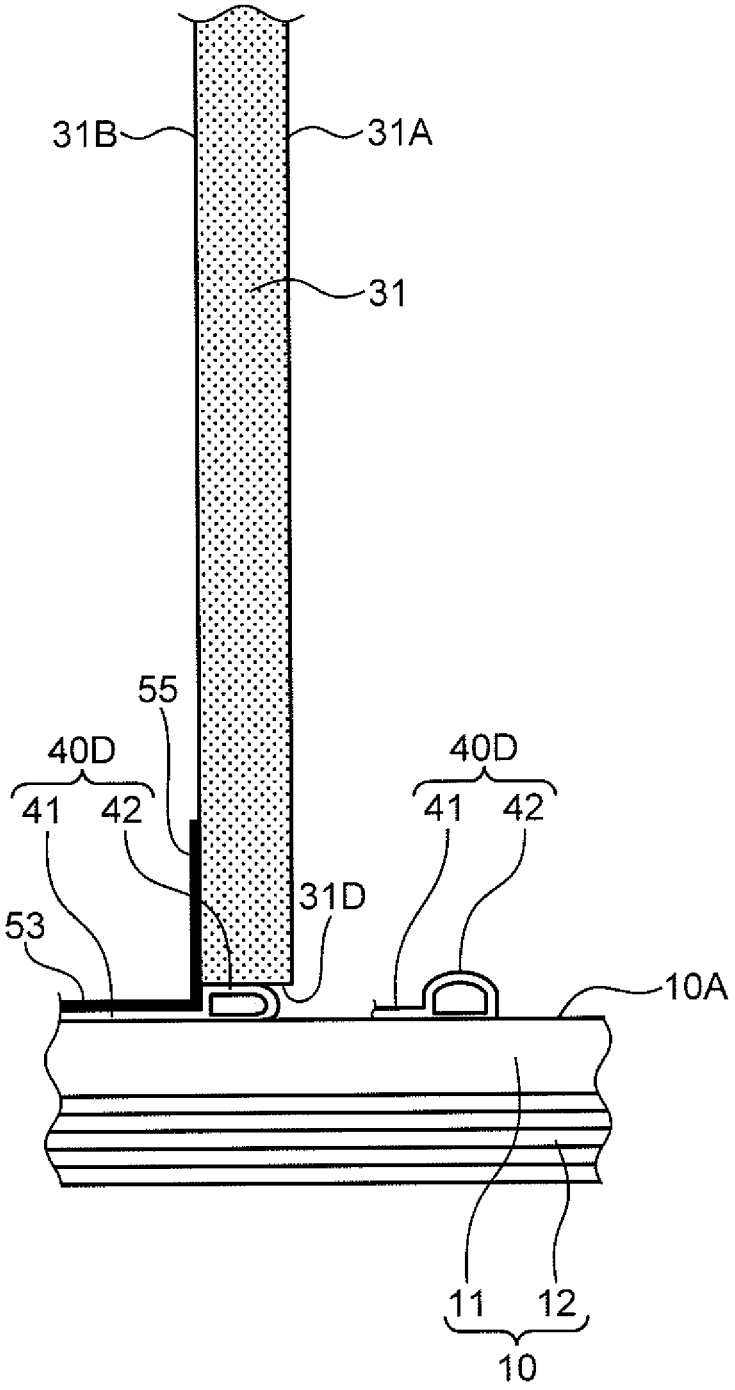
FIG. 10 is a view schematically illustrating a configuration of a sound insulation material in still another modification of the first embodiment of the present invention.

In a sound insulation material 40D illustrated in a modification shown in FIG. 10, the first protruding portion 42 has a hollow structure in which a closed space in a sectional view is formed. The left side in FIG. 10 illustrates the sound insulation material 40D in a state of being sandwiched between the lower end surface 31D of the first face material 31 and the floor surface 10A, and the right side in FIG. 10 illustrates the sound insulation material 40D in a state before being sandwiched between the lower end surface 31D of the first face material 31 and the floor surface 10A. Although not illustrated, the second protruding portion 43 also has a hollow structure similar to that of the first protruding portion 42.

Figure 11:
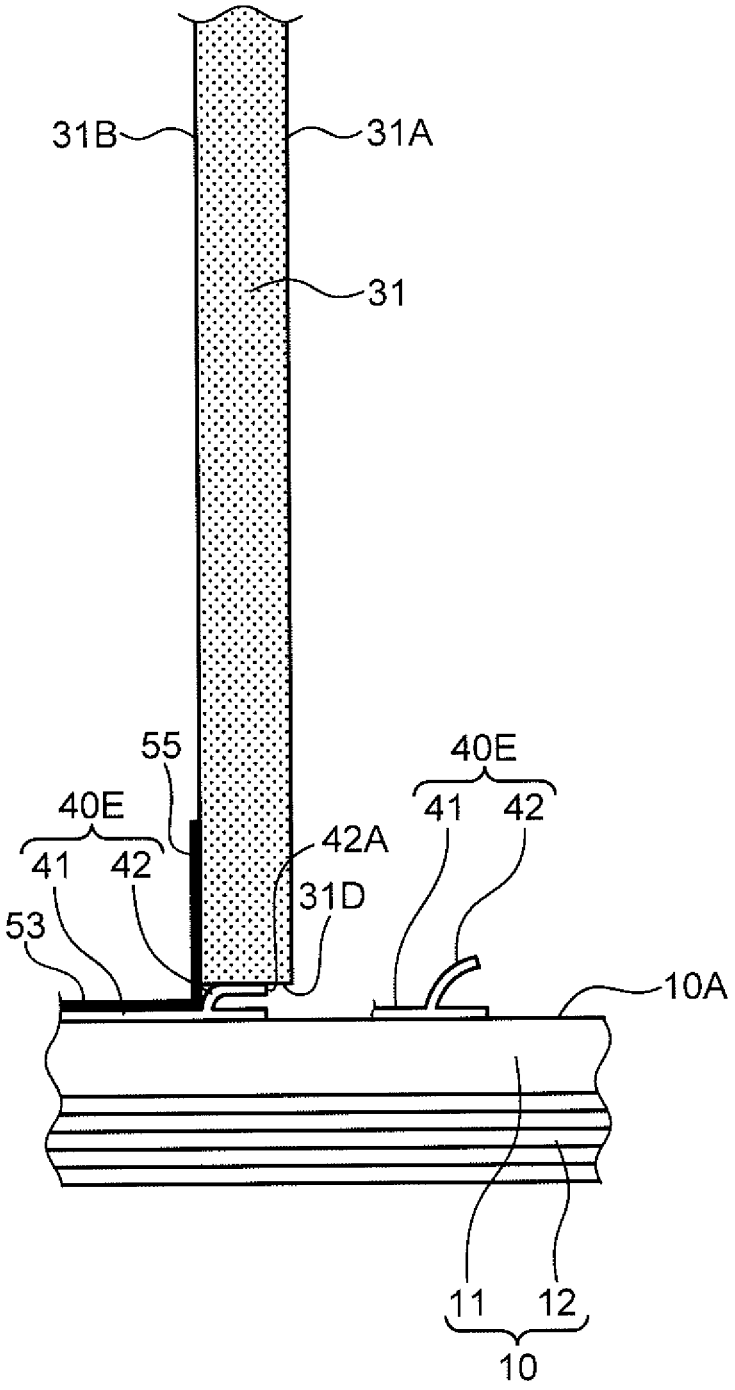
FIG. 11 is a view schematically illustrating a configuration of a sound insulation material in still another modification of the first embodiment of the present invention.

While in a sound insulation material 40E illustrated in a modification shown in FIG. 11, the first protruding portion 42 is curved so as to be away from the sheet portion 41 toward the end portion in the width direction as in the case of the above sound insulation material 40A (FIG. 7), as illustrated on the left side of FIG. 11, even in a state of being sandwiched between the lower end surface 31D of the first face material 31 and the floor surface 10A, the extending end 42A of the first protruding portion 42 is not in contact with the upper surface of the sheet portion 41. Although not illustrated, the second protruding portion 43 is configured similarly to the first protruding portion 42.

Second Embodiment

Next, a partition wall sound insulation structure and a partition wall construction method according to a second embodiment of the present invention will be described with reference to FIGS. 12 to 15. The partition wall sound insulation structure and the partition wall construction method according to the second embodiment, which are basically the same as those of the first embodiment, are different in that the floor-side positioning member 51 is integrally formed with the sheet portion 41. In the following, only differences from the first embodiment will be described.

Figure 12:
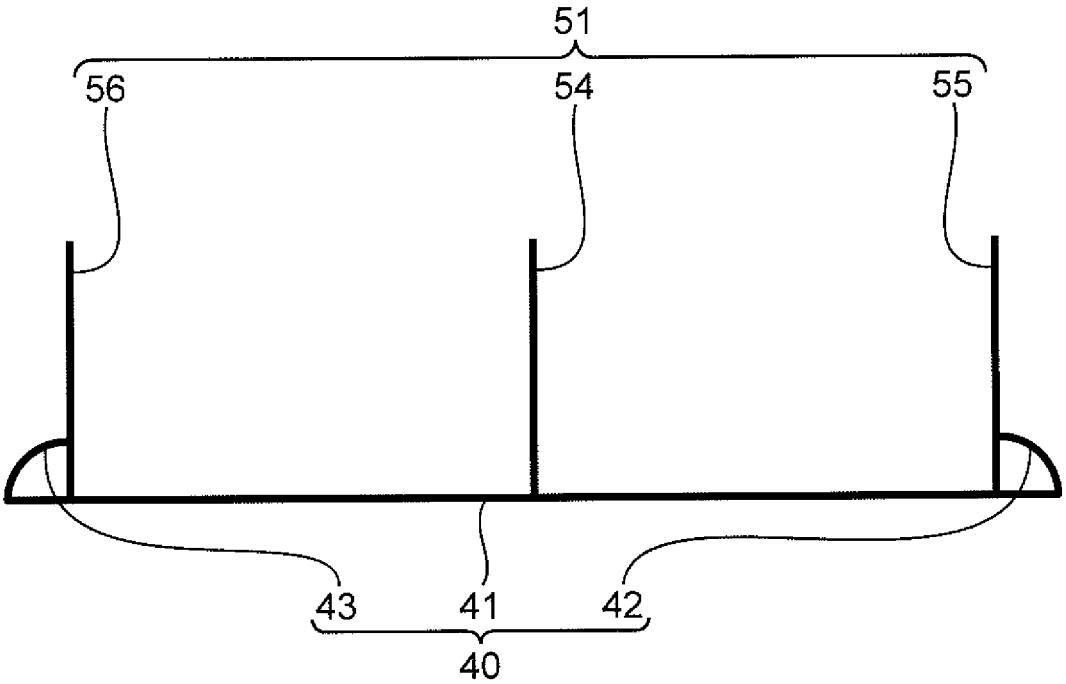
FIG. 12 is a schematic view for explaining a configuration of a positioning member in a second embodiment of the present invention.

The floor-side positioning member 51 in the present embodiment does not have the base portion 53. As illustrated in FIG. 12, the central erect portion 54 is erected perpendicularly to the sheet portion 41 from the central portion in the width direction of the sheet portion 41, and the first end side erect portion 55 and the second end side erect portion 56 are each erected perpendicularly to the sheet portion 41 from each portion on the center side in the width direction with respect to each end portion in the width direction of the sheet portion 41. The extending end of the first protruding portion 42 is in contact with an outer surface of the first end side erect portion 55, and the extending end of the second protruding portion 43 is in contact with an outer surface of the second end side erect portion 56.

Figure 6:
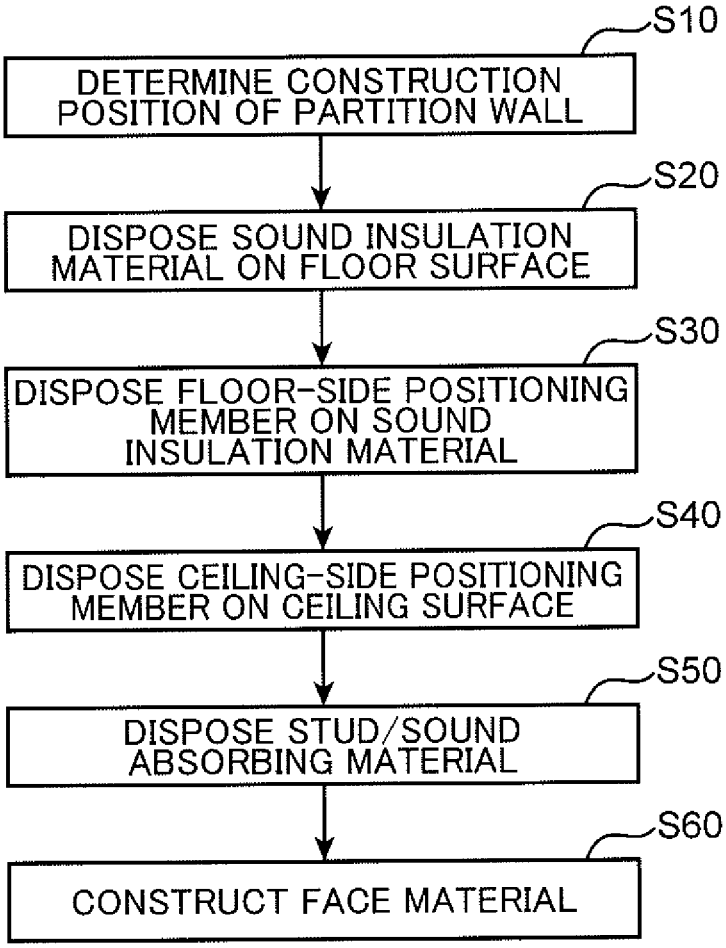
FIG. 6 is a flowchart for explaining a partition wall construction method according to the first embodiment of the present invention.

Since in the partition wall construction method according to the present embodiment, a member in which the floor-side positioning member 51 and the sound insulation material 40 are integrally formed is used, Steps S20 and S30 are simultaneously performed in the flowchart of FIG. 6. Except for this point, the partition wall 30 is constructed by the same procedure as in the first embodiment.

Figure 13:
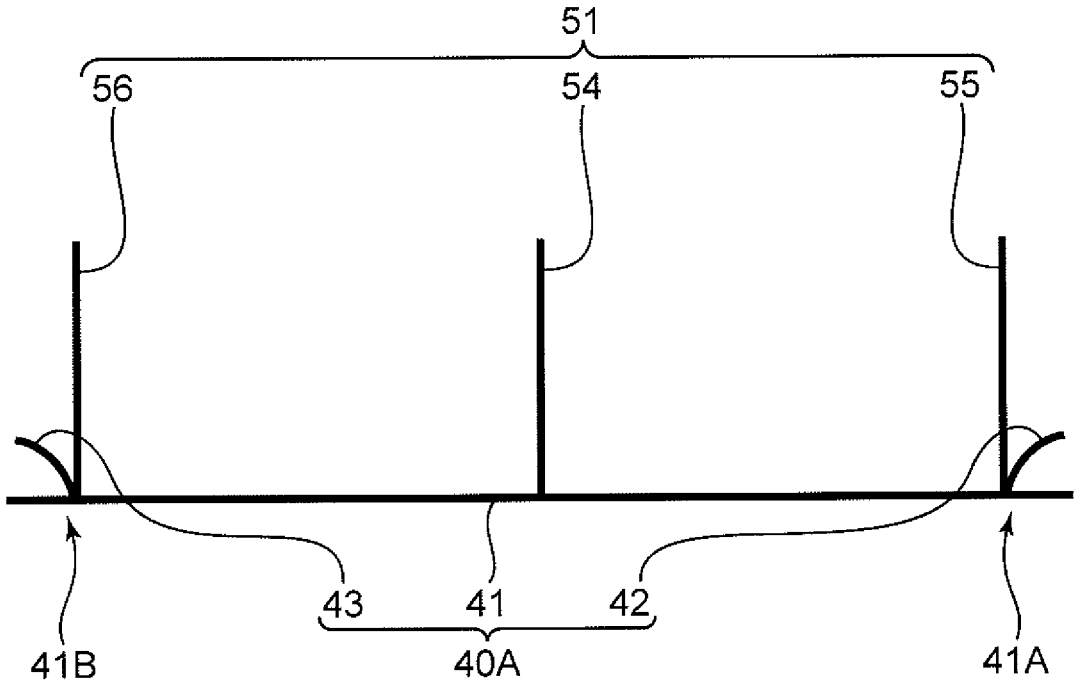
FIG. 13 is a schematic view illustrating a configuration of a positioning member in a modification of the second embodiment of the present invention.
Figure 14:
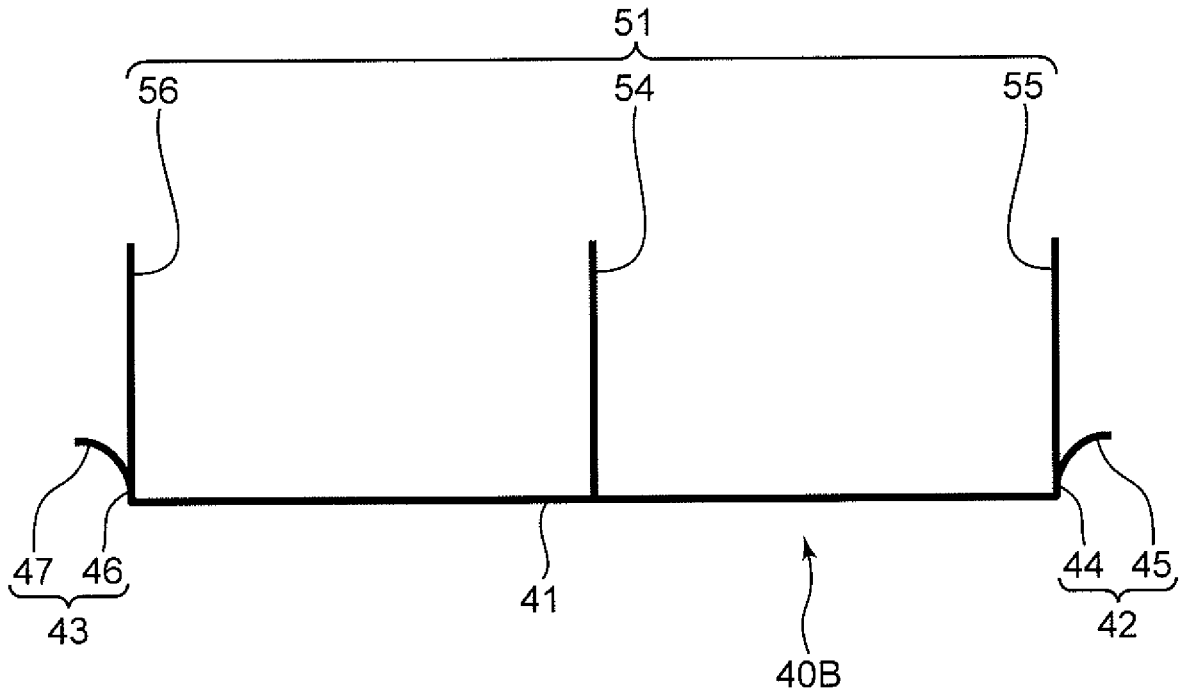
FIG. 14 is a schematic view illustrating a configuration of a positioning member in another modification of the second embodiment of the present invention.
Figure 15:
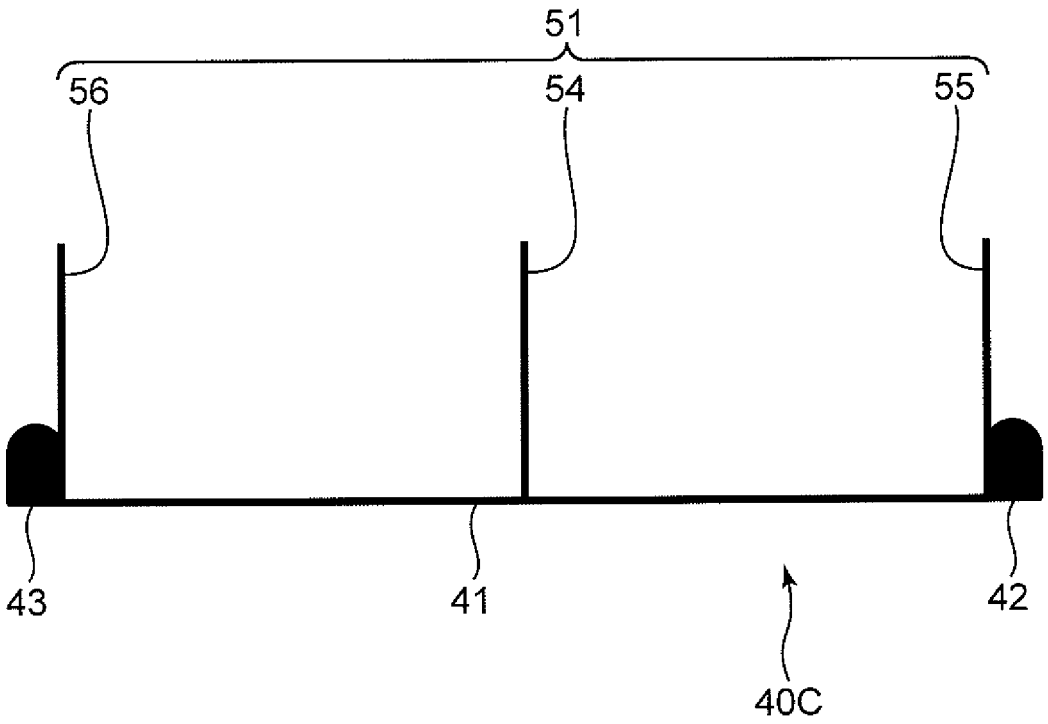
FIG. 15 is a schematic view illustrating a configuration of a positioning member in still another modification of the second embodiment of the present invention.

FIGS. 13 to 15 illustrate modifications of the second embodiment, and are similar to FIG. 12 except for a shape of a sound insulation material. The sound insulation materials in FIGS. 13 to 15 correspond to the sound insulation materials described with reference to FIGS. 7 to 9.

In the configuration of the second embodiment (the floor-side positioning member 51 and the sound insulation material are integrally formed), the floor-side positioning member 51 may have the base portion 53.

Third Embodiment

Next, a partition wall sound insulation structure and a partition wall construction method according to a third embodiment of the present invention will be described. The partition wall sound insulation structure and the partition wall construction method according to the third embodiment, which are basically the same as those of the first embodiment, are different in that the sound insulation material 40 is not laid under the floor-side positioning member 51 but is hooked on the floor-side positioning member 51. In the following, only differences from the first embodiment will be described.

Figure 16:
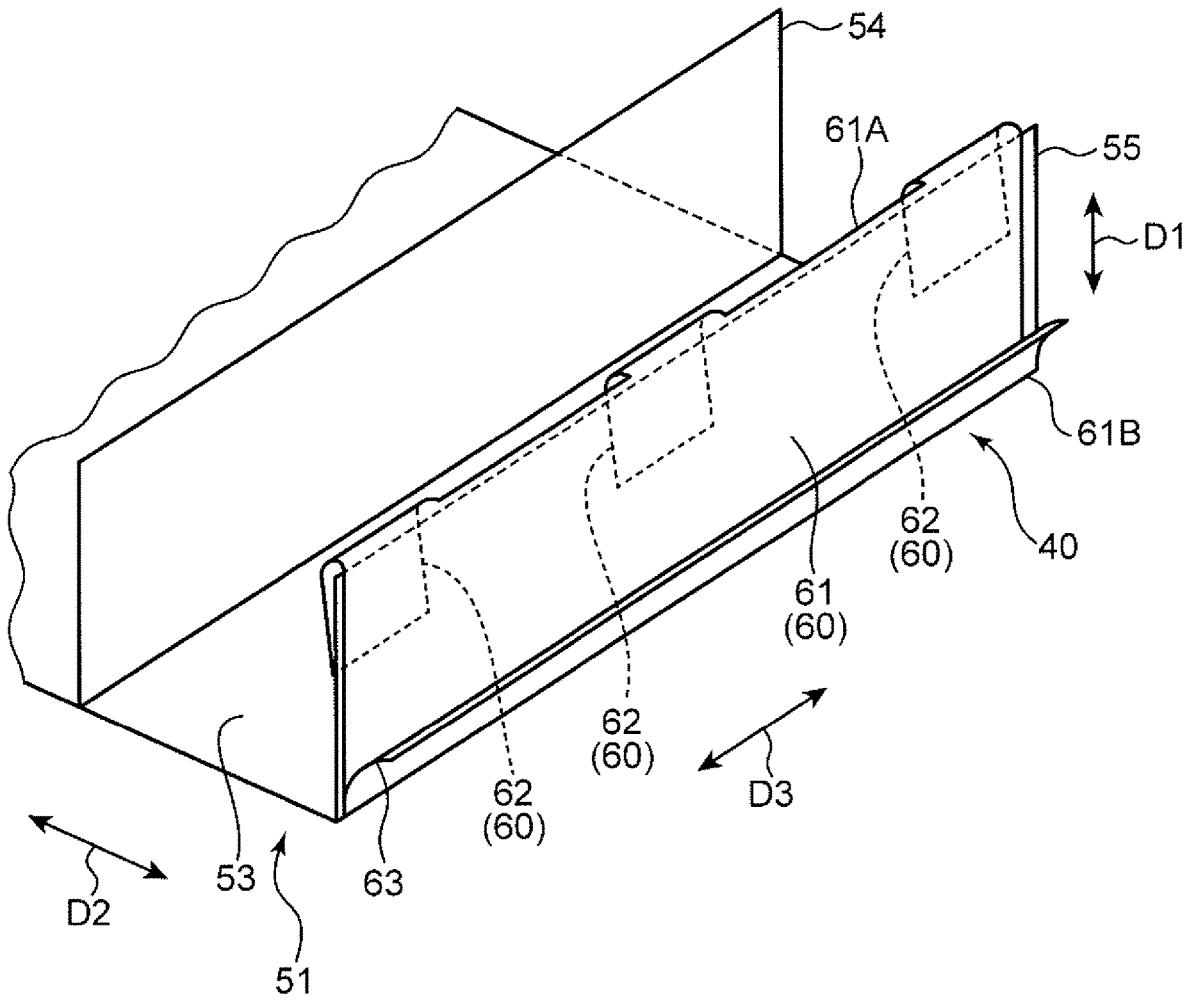
FIG. 16 is a perspective view schematically illustrating a configuration of a sound insulation material in a third embodiment of the present invention.

FIG. 16 illustrates a state in which the sound insulation material 40 in the present embodiment is attached to the floor-side positioning member 51. In FIG. 16, an arrow denoted by reference sign D1 indicates the vertical direction, an arrow denoted by reference sign D2 indicates the wall thickness direction of the partition wall 30, and an arrow denoted by reference sign D3 indicates the wall surface direction of the partition wall 30.

As illustrated in FIG. 16, the sound insulation material 40 in the present embodiment includes a hook portion 60 hooked on the floor-side positioning member 51, and an extended piece 63 extending outward from the hook portion 60. The hook portion 60 includes a main body portion 61 having a rectangular shape in a front view and elongated in the wall surface direction, and a plurality of hook pieces 62 provided at an upper edge 61A of the main body portion 61 at intervals in a length direction.

The hook piece 62 is a plate piece provided so as to be folded back from the upper edge 61A toward a lower edge 61B of the main body portion 61, and a gap is formed between the hook piece and the main body portion 61. As shown in FIG. 16, an upper portion of the first end side erect portion 55 of the floor-side positioning member 51 is inserted into the gap.

Figure 17:
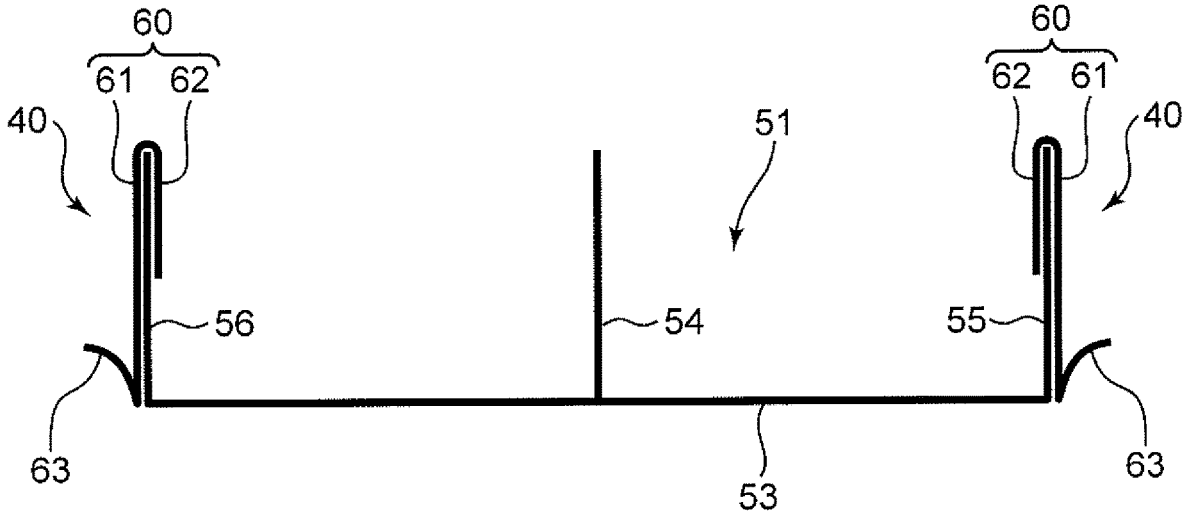
FIG. 17 is a view schematically illustrating the configuration of the sound insulation material in the third embodiment of the present invention.

The extended piece 63 is elastically deformable and extends outward while being curved in an arc shape protruding upward from the lower edge 61B of the main body portion 61. Similar to the first protruding portion 42 in the first embodiment, the extended piece 63 is a portion disposed in the gap between the lower end surface 31D of the first face material 31 and the floor surface 10A in a state of being compressed in the vertical direction. The extended piece 63 is provided over the entire lower edge 61B of the main body portion 61. As shown in FIG. 17, the sound insulation material 40 is also hooked on the second end side erect portion 56 of the floor-side positioning member 51.

In the partition wall construction method according to the present embodiment, in the flowchart of FIG. 6, after the construction position of the partition wall 30 is determined in Step S10, the floor-side positioning member 51 is disposed at the construction position, and then the sound insulation material 40 is hooked on the floor-side positioning member 51. Thereafter, construction in Steps S40 to S60 is performed similarly to the first embodiment. Therefore, in the present embodiment, it is not necessary to lay and fix the sheet-like sound insulation material on the floor surface 10A or the ceiling surface 20A, so that the construction can be easily performed only by hooking the sound insulation material on the floor-side positioning member 51.

Figure 18:
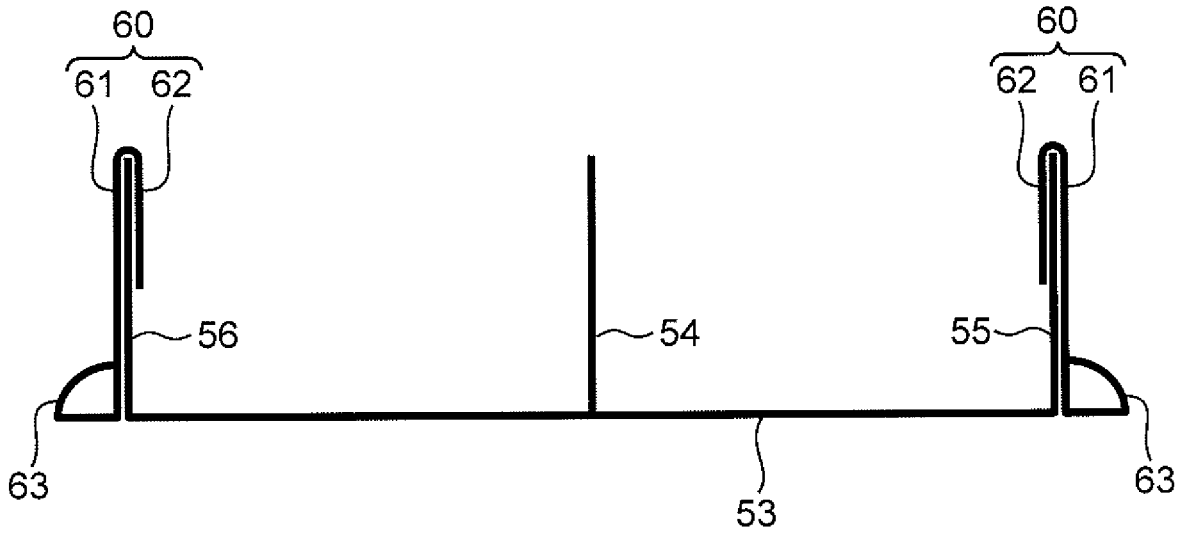
FIG. 18 is a view schematically illustrating a configuration of a sound insulation material in a modification of the third embodiment of the present invention.
Figure 19:
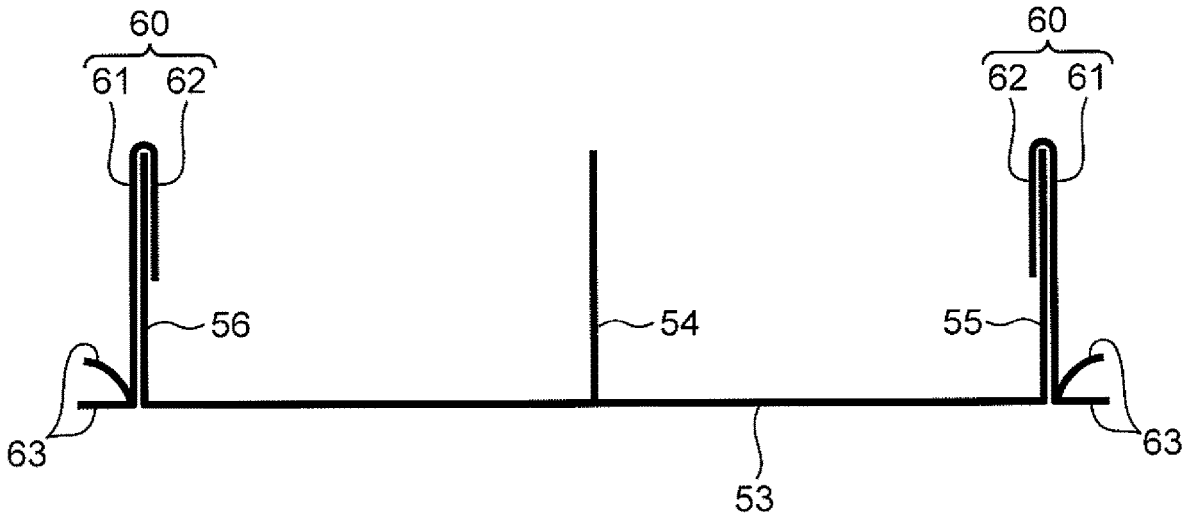
FIG. 19 is a view schematically illustrating a configuration of a sound insulation material in another modification of the third embodiment of the present invention.
Figure 20:
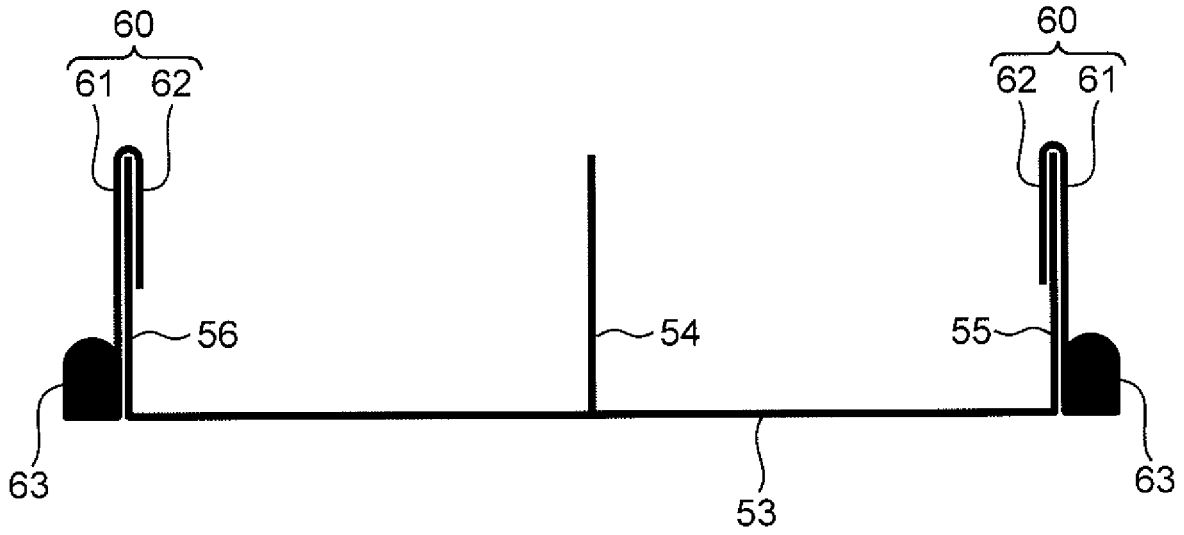
FIG. 20 is a view schematically illustrating a configuration of a sound insulation material in still another modification of the third embodiment of the present invention.

FIGS. 18 to 20 show modifications of the third embodiment, and are the same as FIGS. 16 and 17 except for a shape of the extended piece 63. The shape of the extended piece 63 in FIG. 18 is similar to a shape of an end portion of the sound insulation material 40 in FIG. 2, the shape of the extended piece 63 in FIG. 19 is similar to a shape of an end portion of the sound insulation material 40A in FIG. 7, and the shape of the extended piece 63 in FIG. 20 is similar to a shape of an end portion of the sound insulation material 40C in FIG. 9.

Fourth Embodiment

Next, a partition wall sound insulation structure and a partition wall construction method according to a fourth embodiment of the present invention will be described. The partition wall sound insulation structure and the partition wall construction method according to the fourth embodiment, which are basically similar to those of the third embodiment, are different in further including a spacer hooked on the ceiling-side positioning member 52. In the following, only differences from the third embodiment will be described.

Figure 21:
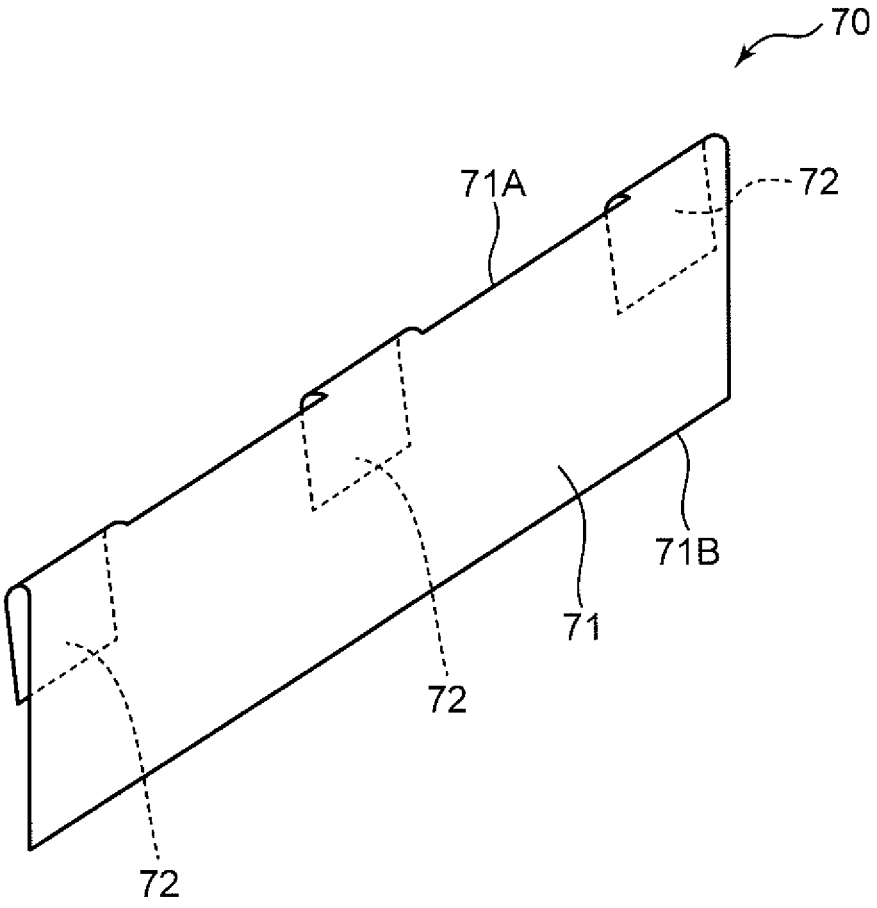
FIG. 21 is a perspective view schematically illustrating a configuration of a spacer in a fourth embodiment of the present invention.

As illustrated in FIG. 21, a spacer 70 is obtained by omitting the extended piece 63 from the sound insulation material 40 (FIG. 16) of the third embodiment, and the other configuration is basically the same as that of the sound insulation material 40. Specifically, the spacer 70 includes a main body portion 71 having a rectangular shape in a front view, and a plurality of hook pieces 72 provided at intervals in a length direction at an upper edge 71A of the main body portion 71. The hook piece 72 is a plate piece provided so as to be folded back from the upper edge 71A toward a lower edge 71B of the main body portion 71, and a gap is formed between the hook piece and the main body portion 71. The material of the spacer 70 is also the same as that of the sound insulation material 40. The spacer 70 is hooked on each of the first end side erect portion 55 and the second end side erect portion 56 of the ceiling-side positioning member 52.

In the present embodiment, by disposing the spacer 70 paired with the sound insulation material 40, the wall thickness of the partition wall 30 can be balanced. Specifically, although when the sound insulation material 40 is hooked on the floor-side positioning member 51, the wall thickness of the partition wall 30 on the floor side becomes larger than that on the ceiling side, and the balance of the wall thickness is impaired, this unbalance can be eliminated by disposing the spacer 70.

Other Embodiments

Here, other embodiments of the present invention will be described.

While the first embodiment has been described, as an example, with respect to the case where the gap is formed between the partition wall 30 and the floor surface 10A, and the sound insulation material 40 is laid on the floor surface 10A, the present invention is not limited thereto. A gap may be formed between the partition wall 30 and the ceiling surface 20A, and the sound insulation material 40 may be fixed to the ceiling surface 20A. In addition, a gap may be formed between the partition wall 30 and the floor surface 10A and a gap may be also formed between the partition wall 30 and the ceiling surface 20A, and the sound insulation material 40 may be fixed to both the floor surface 10A and the ceiling surface 20A.

Even in a case where a gap is formed between the partition wall 30 and the ceiling surface 20A, when the hook-type sound insulation material 40 of the above third embodiment is used, appropriate configuration is applied to prevent the sound insulation material 40 from falling. For example, a hairpin process for sandwiching the ceiling-side positioning member 52 (the first end side erect portion 55 and the second end side erect portion 56) by the main body portion 61 and the hook piece 62 may be performed, or a frictional force or an adhesive strength of a resin (including an adhesive or a tape) or an elastic member may be used.

Figure 22:
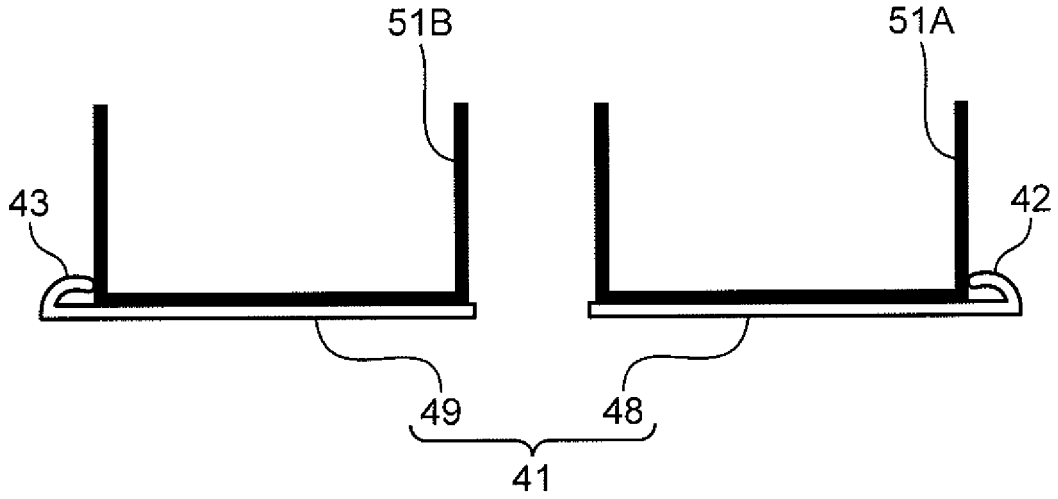
FIG. 22 is a schematic view illustrating a configuration of a positioning member in another embodiment of the present invention.

As illustrated in FIG. 22, the sheet portion 41 may be divided into a first sheet piece 48 having an end portion at which the first protruding portion 42 is provided, and a second sheet piece 49 having an end portion at which the second protruding portion 43 is provided. At this time, the first floor-side positioning member 51A and the second floor-side positioning member 51B formed in a U-shape in a sectional view are respectively placed on upper surfaces of the first sheet piece 48 and the second sheet piece 49. Then, the first sheet piece 48 and the second sheet piece 49 are disposed side by side between the first face material 31 and the second face material 32.

Figure 23:
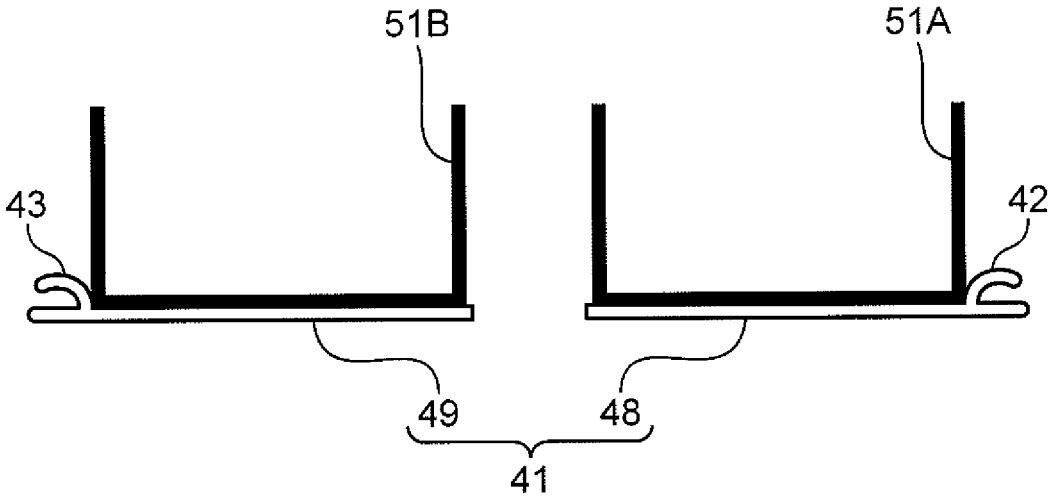
FIG. 23 is a schematic view illustrating a configuration of a positioning member in still another embodiment of the present invention.
Figure 24:
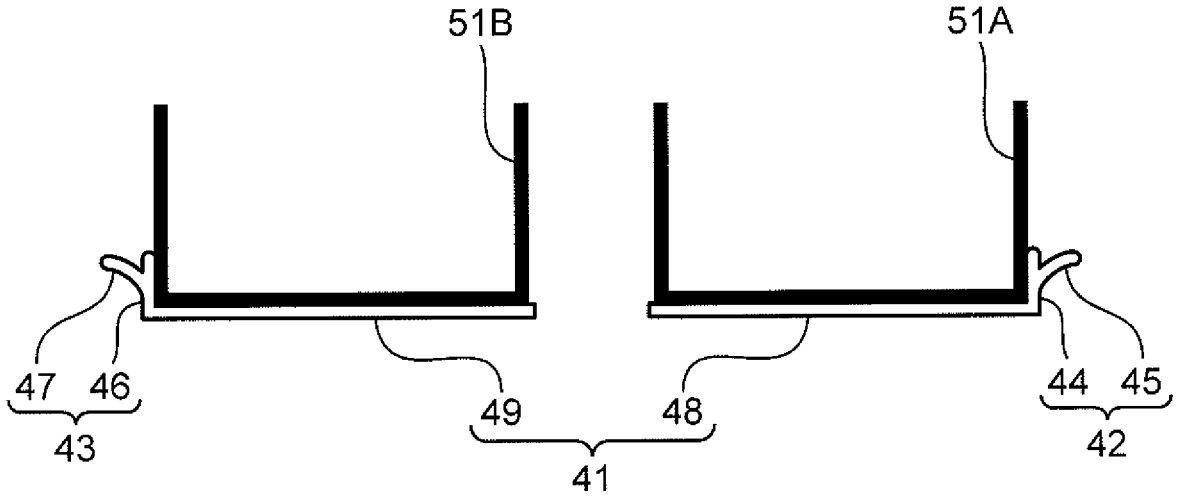
FIG. 24 is a schematic view illustrating a configuration of a positioning member in still another embodiment of the present invention.
Figure 25:
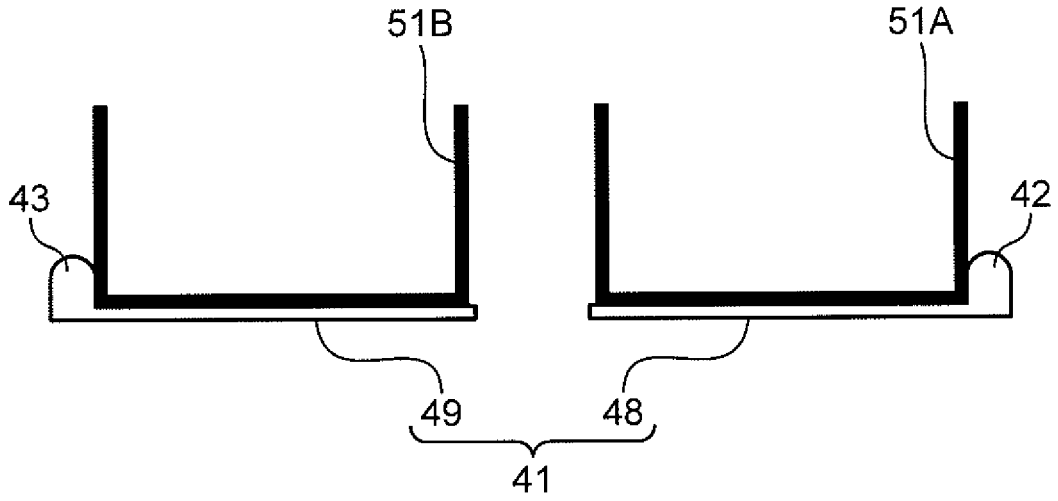
FIG. 25 is a schematic view illustrating a configuration of a positioning member in still another embodiment of the present invention.

FIGS. 23 to 25 are the same as FIG. 22 except for a shape of the end portion of the sound insulation material. The shapes of the end portion of the sound insulation material in FIGS. 23 to 25 correspond to FIGS. 7 to 9, respectively. Although in FIGS. 22 to 25, the floor-side positioning member and the sheet portion 41 are formed as separate bodies, a pair of U-shaped floor-side positioning members may be similarly used even in a case where the floor-side positioning member and the sheet portion 41 are integrally formed. In any case where the floor-side positioning member is separately formed from or integrated with the sheet portion 41, a configuration for connecting the first floor-side positioning member 51A and the second floor-side positioning member 51B to each other may be provided.

In the first to third embodiments and the modifications thereof, the central erect portion 54 may be omitted.

Experimental Example

Figure 26:
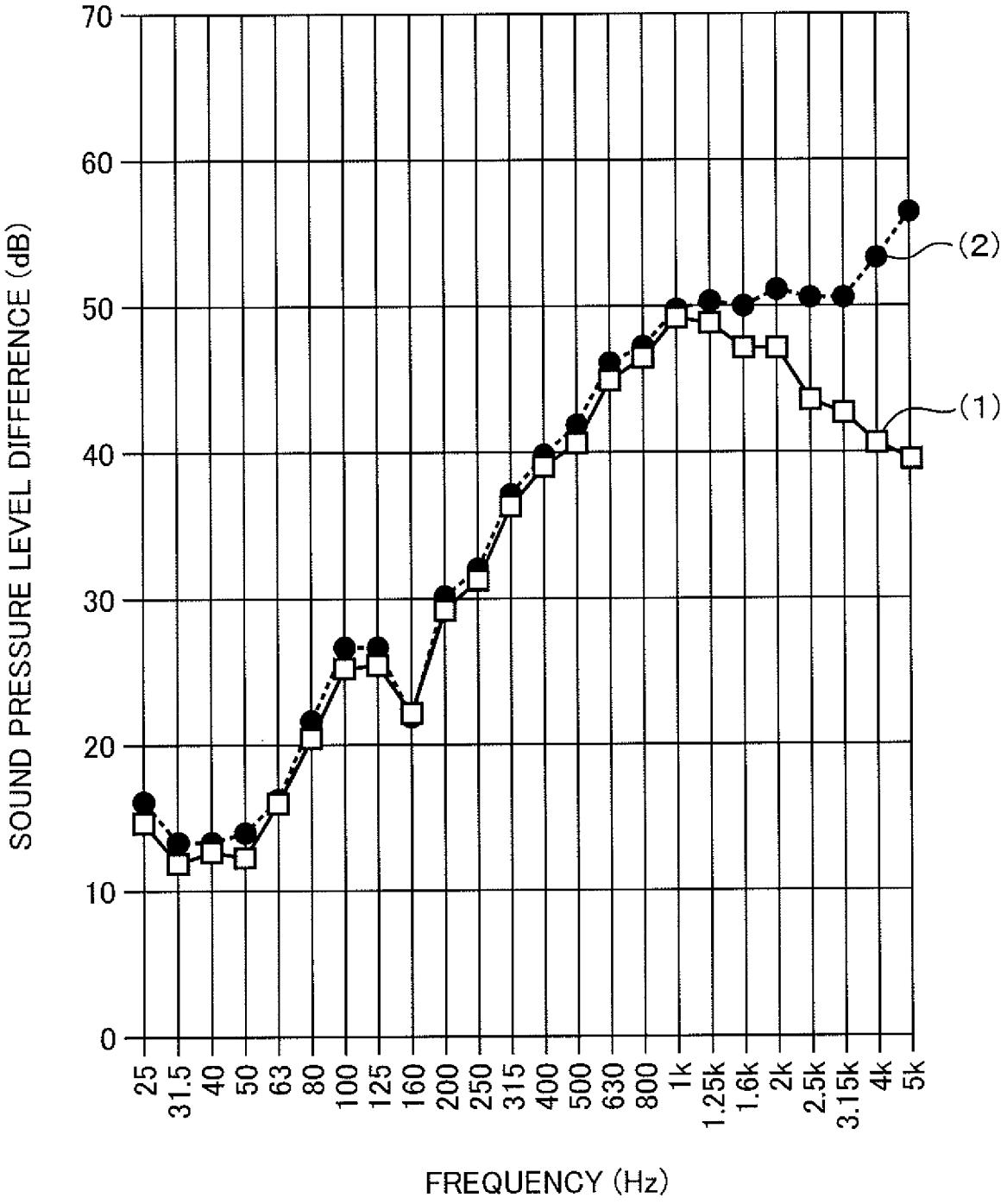
FIG. 26 is a graph showing a result of improvement in sound insulation performance of the partition wall by arrangement of the sound insulation material.

FIG. 26 illustrates a result of improvement in sound insulation performance in a case where a sound insulation material is disposed for blocking a gap between a face material of a partition wall and a floor surface. In FIG. 26, a horizontal axis represents a frequency (Hz), and a vertical axis represents a sound pressure level difference (dB) between adjacent chambers partitioned by partition walls. (1) shows a result obtained in a case where the sound insulation material is disposed and (2) shows a result obtained in a case where the sound insulation material is not disposed as a comparative example. As is clear from the graph, it becomes apparent that the sound insulation performance is improved in a frequency range of 1 kHz or more by disposing the sound insulation material.

The above embodiments are summarized as follows.

A partition wall sound insulation structure according to the above embodiment includes: a floor material on which a floor surface facing an indoor space side is formed; a ceiling material on which a ceiling surface is formed, the ceiling surface being opposed to the floor surface in a vertical direction with an indoor space interposed therebetween; a partition wall that extends in the vertical direction so as to partition the indoor space in a horizontal direction and that is disposed with a gap from at least one surface of the floor surface and the ceiling surface; and a sound insulation material made from an elastic material and including a portion disposed in the gap while being compressed in the vertical direction.

In the partition wall sound insulation structure, the sound insulation material made from an elastic material is disposed in the gap between at least one surface of the floor surface and the ceiling surface and the partition wall, and the sound insulation material is compressed in the vertical direction. As a result, since a restoring force of the sound insulation material is generated, adhesion of the sound insulation material to the partition wall can be improved as compared with a case where the sound insulation material is not in a compressed state. Therefore, according to the partition wall sound insulation structure, sound leakage between chambers through the gap between the partition wall and the at least one surface can be effectively suppressed to further improve sound insulation performance.

In the partition wall sound insulation structure, the partition wall may include: a first face material extending in the vertical direction; and a second face material extending in the vertical direction and disposed with a hollow portion interposed between the first face material and the second face material in the horizontal direction. The sound insulation material may include: a sheet portion disposed on the at least one surface in a range from the first face material to the second face material; and a protruding portion that protrudes in a sheet thickness direction from an end portion in a width direction of the sheet portion. The protruding portion may be disposed in the gap in a state of being compressed in the vertical direction.

According to this configuration, a partition wall having excellent sound insulation performance can be easily constructed by laying the sheet-like sound insulation material having a width corresponding to a distance between the first face material and the second face material on the at least one surface, and push-contracting the protruding portion of the sound insulation material by each face material.

In the partition wall sound insulation structure, the partition wall may further include a stud that is disposed in the hollow portion and supports the first face material or the second face material. The partition wall sound insulation structure may further include a positioning member that is provided on the sheet portion and positions the stud.

According to this configuration, the top of the sheet portion of the sound insulation material can be used as a space for disposing the positioning member.

In the partition wall sound insulation structure, the positioning member may be configured as a separate body from the sheet portion. In addition, the positioning member may be integrally formed with the sheet portion.

In the partition wall sound insulation structure, an end portion in the width direction of the sound insulation material may be formed in a shape that becomes thicker toward a center in the width direction of the sound insulation material.

According to this configuration, at the time of constructing the partition wall, when one of an upper end portion and a lower end portion of each face material is rotated around the other of the upper end portion and the lower end portion toward the center of the partition wall, the end portion of each face material is easily pressed against the end portion of the sound insulation material.

In the partition wall sound insulation structure, the sound insulation material has a width falling within a thickness range of the partition wall.

According to this configuration, the end portion of the sound insulation material can be prevented from protruding to the outside of the partition wall, and design of the building can be maintained.

In the partition wall sound insulation structure, the partition wall may include: a first face material extending in the vertical direction; a second face material extending in the vertical direction and disposed with a hollow portion interposed between the first face material and the second face material in the horizontal direction; and a stud that is disposed in the hollow portion and supports the first face material or the second face material. The partition wall sound insulation structure may further include a positioning member that positions the stud. The sound insulation material may include: a hook portion hooked on the positioning member; and an extended piece extending outward from the hook portion and disposed in the gap in a state of being compressed in the vertical direction.

According to this configuration, it is not necessary to fix the sound insulation material to the floor surface or the ceiling surface, and construction can be easily performed only by hooking the sound insulation material on the positioning member.

In the partition wall sound insulation structure, the positioning member may include a floor-side positioning member disposed on a floor surface side; and a ceiling-side positioning member disposed on a ceiling surface side. The hook portion of the sound insulation material may be hooked on one of the floor-side positioning member and the ceiling-side positioning member. The partition wall sound insulation structure may further include a spacer hooked on the other of the floor-side positioning member and the ceiling-side positioning member.

According to this configuration, a wall thickness of the partition wall can be balanced on the floor side and the ceiling side.

The partition wall construction method according to the above embodiment is a method of constructing a partition wall that partitions an indoor space in a horizontal direction in a building including a floor material on which a floor surface facing an indoor space side is formed; and a ceiling material on which a ceiling surface is formed, the ceiling surface being opposed to the floor surface in a vertical direction with the indoor space interposed therebetween. This method includes: disposing a sound insulation material made from an elastic material at a construction position where the partition wall is to be constructed on at least one surface of the floor surface and the ceiling surface; and constructing the partition wall at the construction position such that the sound insulation material is sandwiched between the partition wall and the at least one surface and compressed in the vertical direction.

In this method, the sound insulation material made from an elastic material is sandwiched between at least one surface of the floor surface and the ceiling surface and the partition wall, so that the sound insulation material is compressed in the vertical direction. As a result, a restoring force of the sound insulation material is generated, so that adhesion of the sound insulation material to the partition wall can be improved. Accordingly, sound leakage through the gap between the partition wall and the at least one surface can be effectively suppressed to further improve sound insulation performance.

It should be understood that the embodiments disclosed herein are illustrative in all respects and are not restrictive. The scope of the present invention is indicated not by the above description but by the claims, and it is intended that meanings equivalent to the claims and all modifications within the scope are included.

The invention claimed is:

1. A partition wall sound insulation structure comprising:

a floor material on which a floor surface facing an indoor space side is formed;

a ceiling material on which a ceiling surface is formed, the ceiling surface being opposed to the floor surface in a vertical direction with an indoor space interposed therebetween;

a partition wall that extends in the vertical direction so as to partition the indoor space in a horizontal direction and that is disposed with a gap from at least one surface of the floor surface and the ceiling surface; and a sound insulation material made from an elastic material and including a portion disposed in the gap while being compressed in the vertical direction, wherein the partition wall includes:

a first face material extending in the vertical direction; and a second face material extending in the vertical direction and disposed with a hollow portion interposed between the first face material and the second face material in the horizontal direction, the sound insulation material includes:

a sheet portion disposed on the at least one surface of the floor surface and the ceiling surface in a range from the first face material to the second face material; and protruding portions that protrude in a sheet thickness direction from end portions in a width direction of the sheet portion, the protruding portions being disposed in the gap in a state of being compressed in the vertical direction, the partition wall further includes a stud that is disposed in the hollow portion and supports the first face material or the second face material, the partition wall sound insulation structure further comprising a positioning member that is provided on the sheet portion and positions the stud, the protruding portions are compressed between the first face material and the second face material, and the at least one surface of the floor surface and the ceiling surface in the vertical direction, and the sheet portion extends from one of the protruding portions to the other of the protruding portions.

2. The partition wall sound insulation structure according to claim 1, wherein the positioning member is configured as a separate body from the sheet portion.

3. The partition wall sound insulation structure according to claim 1, wherein the positioning member is integrally formed with the sheet portion.

4. The partition wall sound insulation structure according to claim 1, wherein an end portion in the width direction of the sound insulation material is formed in a shape that becomes thicker toward a center in the width direction of the sound insulation material.

5. The partition wall sound insulation structure according to claim 1, wherein the sound insulation material has a width falling within a thickness range of the partition wall.

6. A partition wall sound insulation structure comprising:

a floor material on which a floor surface facing an indoor space side is formed;

a ceiling material on which a ceiling surface is formed, the ceiling surface being opposed to the floor surface in a vertical direction with an indoor space interposed therebetween;

a partition wall that extends in the vertical direction so as to partition the indoor space in a horizontal direction and that is disposed with a gap from at least one surface of the floor surface and the ceiling surface; and a sound insulation material made from an elastic material and including a portion disposed in the gap while being compressed in the vertical direction, wherein the partition wall includes:

a first face material extending in the vertical direction;

a second face material extending in the vertical direction and disposed with a hollow portion interposed between the first face material and the second face material in the horizontal direction; and a stud that is disposed in the hollow portion and supports the first face material or the second face material, the partition wall sound insulation structure further comprising a positioning member that positions the stud, and the sound insulation material includes:

a hook portion hooked on the positioning member; and an extended piece extending outward from the hook portion and disposed in the gap in a state of being compressed in the vertical direction.

7. The partition wall sound insulation structure according to claim 6, wherein the positioning member includes:

a floor-side positioning member disposed on a floor surface side; and a ceiling-side positioning member disposed on a ceiling surface side, and the hook portion of the sound insulation material is hooked on one of the floor-side positioning member and the ceiling-side positioning member, the partition wall sound insulation structure further comprising a spacer hooked on the other of the floor-side positioning member and the ceiling-side positioning member.

* * * * *